United States Patent [19]

Upchurch

[11] Patent Number: 5,050,675

[45] **Date of Patent: * Sep. 24, 1991**

[54] PERFORATING AND TESTING APPARATUS INCLUDING A MICROPROCESSOR IMPLEMENTED CONTROL SYSTEM RESPONSIVE TO AN OUTPUT FROM AN INDUCTIVE COUPLER OR OTHER INPUT STIMULUS

[75] Inventor: James M. Upchurch, Sugerland, Tex.

[73] Assignee: Schlumberger Technology Corporation, Houston, Tex.

[ * ] Notice: The portion of the term of this patent subsequent to Jan. 10, 2006 has been disclaimed.

[21] Appl. No.: 565,774

[22] Filed: Aug. 10, 1990

Related U.S. Application Data

[62] Division of Ser. No. 454,091, Dec. 20, 1989, Pat. No. 4,971,160.

[51] Int. Cl.[5] ..... E21B 34/06

[52] U.S. Cl. ..... 166/250; 166/65.1; 166/66.5; 166/373; 166/386; 339/DIG. 2

[58] Field of Search ..... 166/373, 386, 65.1, 166/66.4, 66, 66.5, 72, 316, 332; 336/DIG. 2, 129, 211; 340/853-856

[56] References Cited

U.S. PATENT DOCUMENTS

| | | | |
|---|---|---|---|
| 2,370,818 | 3/1945 | Silverman | 175/50 |
| 3,544,035 | 10/1985 | Voss | 166/299 |
| 3,743,989 | 7/1973 | Nicolas et al. | 336/DIG. 2 |
| 4,566,534 | 1/1986 | Going, III | 166/66.4 |
| 4,796,699 | 1/1989 | Upchurch | 166/66.4 |
| 4,806,928 | 2/1989 | Veneruso | 336/DIG. 2 |
| 4,852,648 | 8/1989 | Akkerman et al. | 166/66.4 |
| 4,886,114 | 12/1989 | Perkins et al. | 166/65.1 |
| 4,896,722 | 1/1990 | Upchurch | 166/65.1 |
| 4,901,069 | 2/1990 | Veneruso | 336/DIG. 2 |
| 4,915,168 | 4/1990 | Upchurch | 166/66.4 |

*Primary Examiner*—Bruce M. Kisliuk

*Attorney, Agent, or Firm*—Henry N. Garrana; John H. Bouchard

[57] ABSTRACT

An input stimulus provides a necessary input to a microprocessor implemented control system. The control system may fire one or more perforating guns of a perforating apparatus or it may change the state of a valve in a well testing apparatus. The input stimuli may comprise a pressure pulse transmitted down a well annulus disposed between a tubing string and a borehole casing, a pressure pulse transmitted internally down the tubing string, an output of a strain gauge for sensing the set down weight of a well tool disposed in the borehole, or an output of an inductive coupler connected to the well surface.

6 Claims, 6 Drawing Sheets

FIG.1
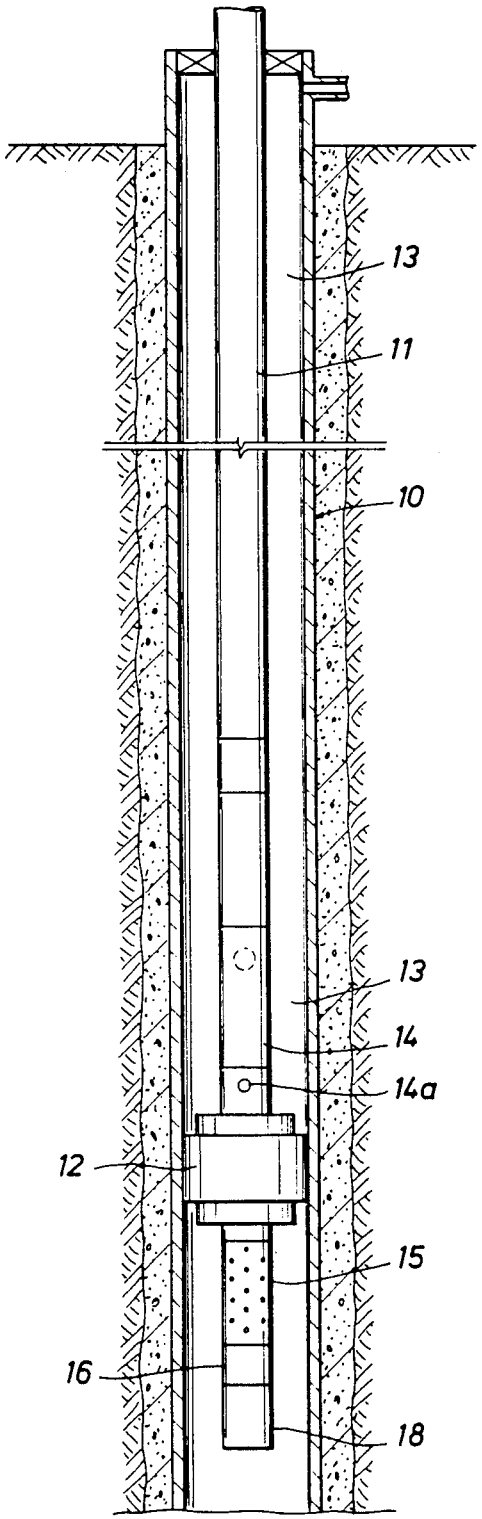
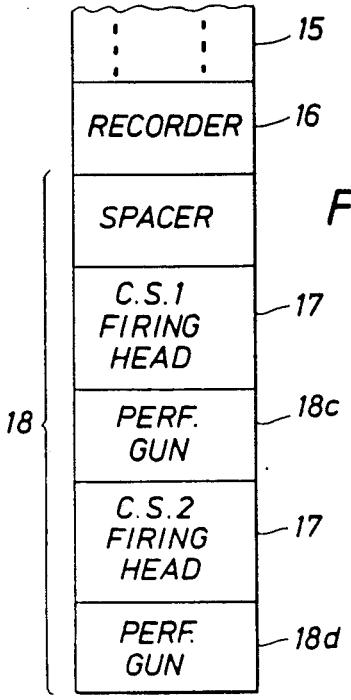
FIG.2a
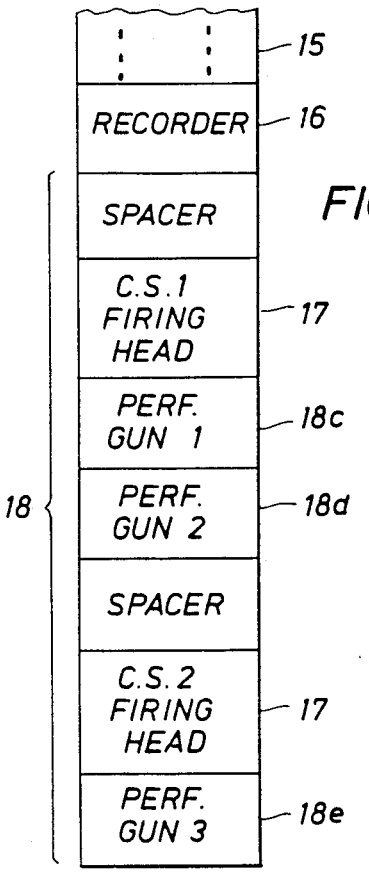
FIG.2b

FIG. 3
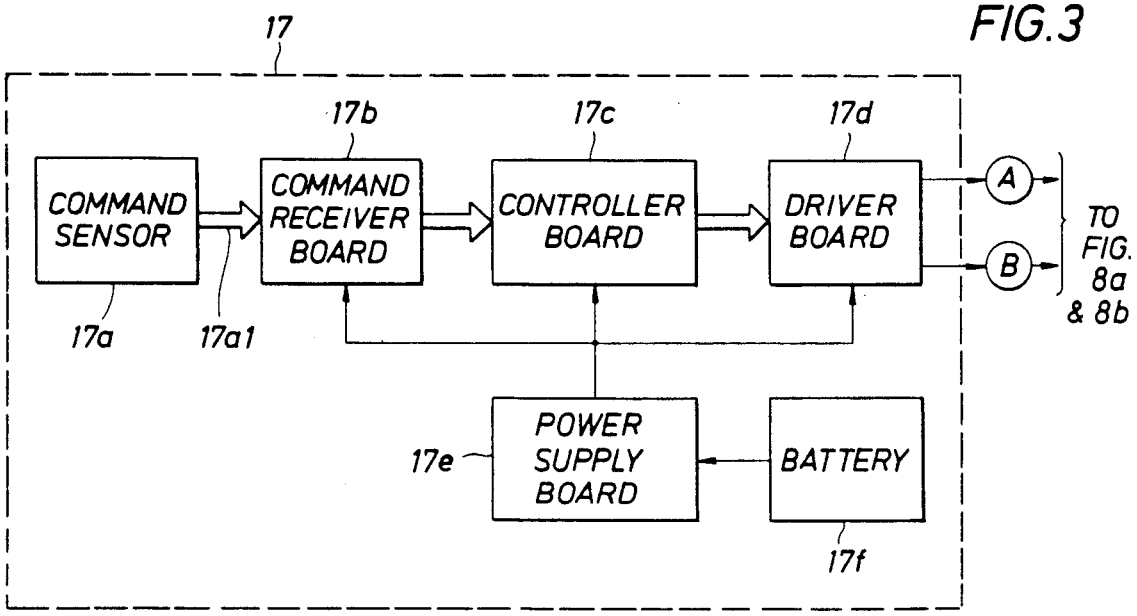
FIG. 4
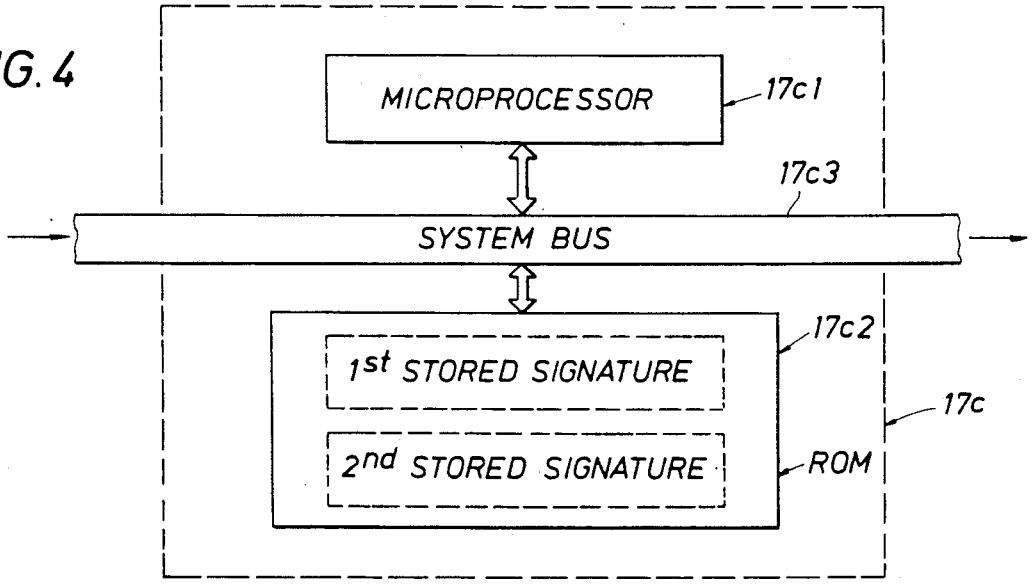
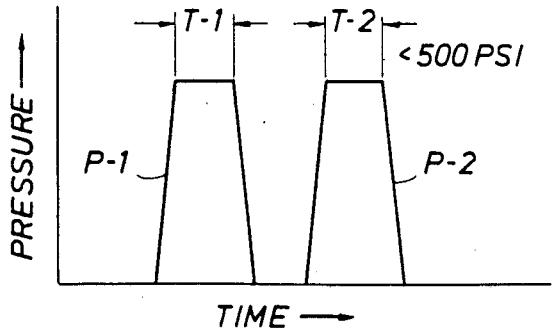
FIG. 5

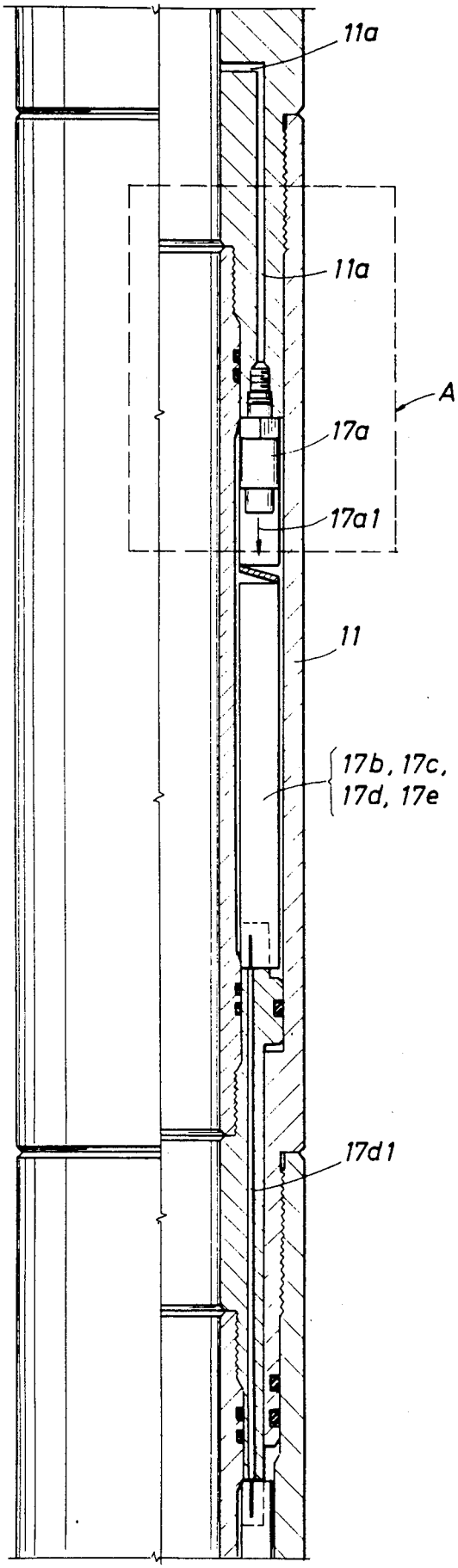
FIG. 6
FIG. 7
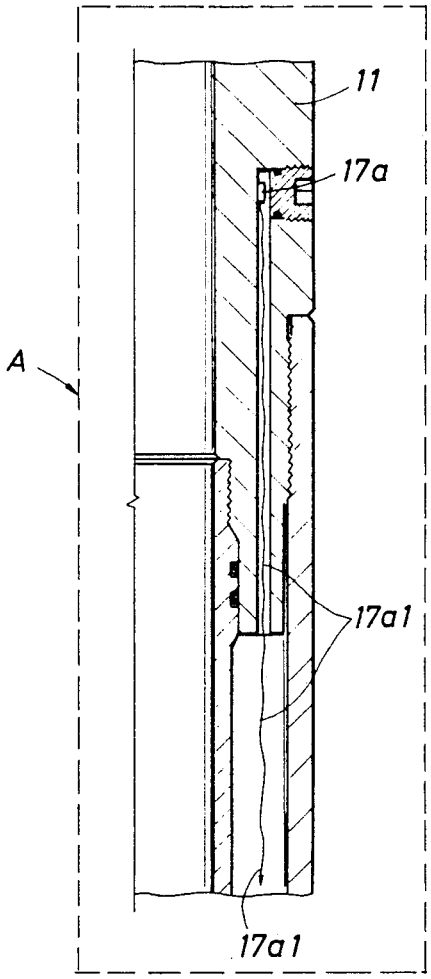

PERFORATING AND TESTING APPARATUS INCLUDING A MICROPROCESSOR IMPLEMENTED CONTROL SYSTEM RESPONSIVE TO AN OUTPUT FROM AN INDUCTIVE COUPLER OR OTHER INPUT STIMULUS

This is a division of application Ser. No. 454,091, filed Dec. 20, 1989, now U.S. Pat. No. 4,971,160.

BACKGROUND OF THE INVENTION

The subject matter of the present invention relates to perforating and testing apparatus, and more particularly, to a microprocessor implemented control system responsive to either an output signal from a latched inductive coupler or other input stimuli for operating either a perforating gun or a solenoid actuated valve in a well testing system.

Recent innovations by applicant have included a well tool control system adapted for controlling a state of a valve in a well tool and an inductive coupler adapted for transmitting control and/or data signals between a first unit and a second unit, and in particular, between wellbore apparatus and a well surface. For example, U.S. Pat. Nos. 4,796,699 and 4,856,595 disclose the well tool control system and U.S. Pat. No. 4,806,928 discloses the inductive coupler, the disclosures of which are incorporated by reference into this specification. In addition, application Ser. No. 295,614 filed Jan. 10, 1989 entitled "Multiple Well Tool Control Systems in a Multi-Valve Well Testing System" and Ser. No. 295,874 filed Jan. 11, 1989 entitled "Multiple Well Tool Control Systems in a Multi-Valve Well Testing System having Automatic Control Modes" disclose further improvements with respect to the above referenced well tool control system; and application Ser. No. 310,804 filed Feb. 14, 1989 entitled "Apparatus for Electromagnetically Coupling Power and Data Signals Between a First Unit and a Second Unit and in particular between Well Bore Apparatus and the Surface" discloses further improvements with respect to the above referenced inductive coupler, the disclosures of which are incorporated by reference into this specification. However, these well tool control systems are used primarily in conjunction with well testing systems and not in conjunction with perforating apparatus. Furthermore, these well tool control systems are not disclosed as being responsive to an output signal from an inductive coupler.

SUMMARY OF THE INVENTION

It is a primary object of the present invention to disclose a perforating apparatus which is responsive to an output signal from a microprocessor implemented control system, the control system being responsive to various input stimuli.

It is a further object of the present invention to disclose a solenoid actuated valve or other such well testing system which is responsive to an output signal from a microprocessor implemented control system, the control system being responsive to an output signal from an inductive coupler.

It is a further object of the present invention to disclose the microprocessor implemented control system associated with the perforating apparatus as being responsive to various input stimuli, such as tubing pressure pulses, annulus pressure pulses, and an output from a strain gauge.

These and other objects of the present invention are achieved, in accordance with one embodiment of the present invention, by providing a perforating apparatus, including a lowermost perforating gun and an uppermost perforating gun for perforating a lowermost and an uppermost portion of a borehole formation, which is responsive to a microprocessor implemented control system housed within the walls of tubing immediately above the uppermost perforating gun. The control system generates one or more output signals (one signal detonating the lowermost perforating gun, another signal detonating the uppermost perforating gun) in response to various input stimuli. For example, the control system may be responsive to annulus pressure between the tubing and the borehole casing, to tubing pressure existing below a set packer, and to an output signal from a strain gauge mounted on the tubing string wall. In addition, another embodiment of the present invention includes a solenoid actuated valve apparatus responsive to at least two output signals from a microprocessor implemented control system. In this embodiment, the control system is responsive to an output signal from an inductive coupler embodied within the well tool. The inductive coupler includes a female coil disposed within the walls of the tubing having wires connected to the control system and a male coil adapted to be lowered into the tubing string concentrically with respect to the female coil. When the male coil is lowered to a position within the tubing which is concentric with respect to the female coil, the female coil generates an output signal which energizes the microprocessor implements control system, the control system generating one of two control signals depending upon the signature of the output signal from the female coil, a control signal changing a state of the valve associated with the valve apparatus.

Further scope of applicability of the present invention will become apparent from the detailed description presented hereinafter. It should be understood, however, that the detailed description and the specific examples, while representing a preferred embodiment of the invention, are given by way of illustration only, since various changes and modifications within the spirit and scope of the invention will becomes obvious to one skilled in the art from a reading of the following detailed description.

BRIEF DESCRIPTION OF THE DRAWINGS

A full understanding of the present invention will be obtained from the detailed description of the preferred embodiment presented hereinafter, and the accompanying drawings, which are given by way of illustration only and are not intended to be limitative of the present invention, and wherein:

FIG. 1 illustrates a well testing system and attached perforating apparatus, embodied in a well tool, in accordance with one embodiment of the present invention;

FIG. 2*a* and 2*b* illustrate the attached perforating apparatus including a novel apparatus and method for firing a perforating gun in accordance with the one embodiment of the present invention;

FIG. 3 illustrates a microprocessor implemented control system embodied in the well tool for firing the perforating gun, the control system being responsive to various input stimuli;

FIG. 4 illustrates in greater detail the controller board associated with the control system of FIG. 3;

FIG. 5 illustrates a first input stimulus;

FIGS. 6 and 7 illustrate a second and third input stimulus;

DETAILED DESCRIPTION OF THE PREFERRED EMBODIMENT

Figure 8A:
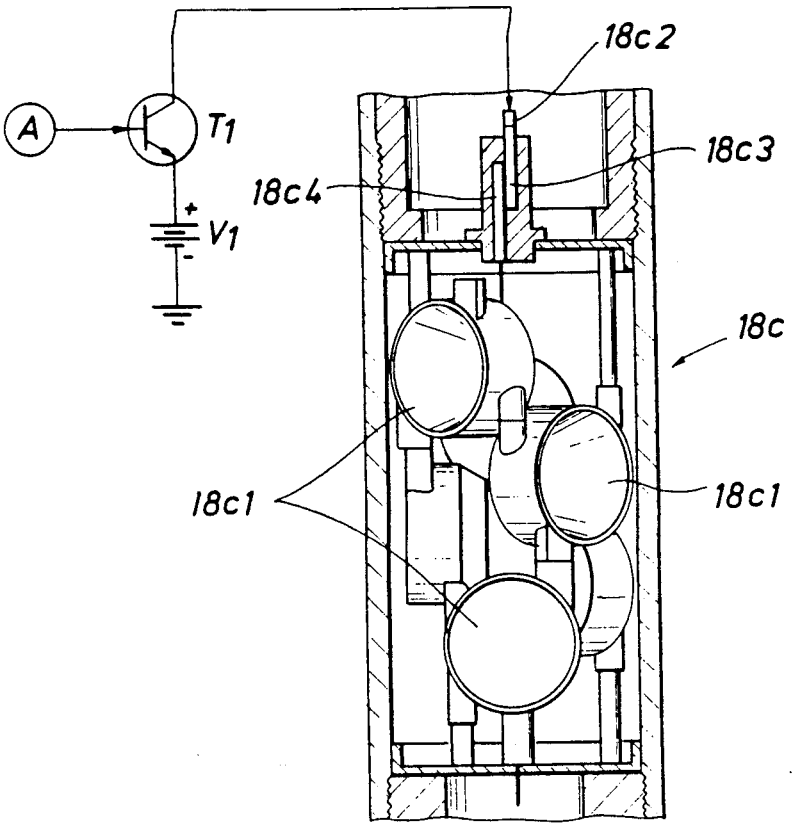
FIGS. 8*a* and 8*b* illustrate a portion of the attached perforating apparatus of FIG. 2*b* including a lowermost perforating gun and an uppermost perforating gun responsive to the output signals from the control system of FIG. 3.

Referring to FIG. 1, a well testing apparatus includes a string of drill stem testing tools shown suspended in a well bore 10 on drill pipe or tubing 11. The testing tools comprise a typical packer 12 that acts to isolate the well interval being tested from the hydrostatic head of fluids standing in the annulus space 13 thereabove, and a main test valve assembly 14 that serves to permit or to prevent the flow of formation fluids from the isolated interval into the pipe string 11. The main test valve 14 is closed while the tools are being lowered, so that the interior of the tubing provides a low pressure region into which formation fluids can flow. After the packer 12 is set, the valve 14 is opened for a relatively short flow period of time during which pressures in the well bore are reduced. Then, the valve 14 is closed for a longer flow period of time during which pressure build-up in the shut-in well bore is recorded. Other equipment components such as a jar and a safety joint can be coupled between the test valve 14 and the packer 12, but are not illustrated in the drawing because they are notoriously well known. A perforated tail pipe 15 is connected to the lower end of the mandrel of the packer 12 to enable fluids in the well bore to enter the tool string, and typical pressure recorders 16 are provided for the acquisition of pressure data as the test proceeds.

In accordance with one embodiment of the present invention, a perforating apparatus 18 is attached to the well testing apparatus of FIG. 1, the perforating apparatus 18 including one or more microprocessor implemented control systems 17 embodied in the walls of perforating apparatus 18 and one or more perforating guns 18*c*–18*e* responsive to the output signals from the control systems 17. The perforating apparatus 18 houses the pressure recorders 16. The control system 17 is adapted to be responsive to various input stimuli, namely, to (1) changes in annulus pressure present in the annulus space 13; (2) changes in tubing pressure present within tubing 11, or to (3) an output from a strain gauge, the details of which will be discussed in more detail below. The annulus pressure in annulus space 13 communicates with control system 17 via port 14*a*, and an internal conduit through the packer 12 and slotted tail pipe 15.

Referring to FIGS. 2*a* and 2*b*, two embodiments of the perforating apparatus 18 of FIG. 1 are illustrated.

In FIG. 2*a*, one embodiment of the perforating apparatus 18 is suspended from pressure recorder 16, which is suspended from the slotted tail pipe 15. The perforating apparatus 18 in FIG. 2*a* includes first microprocessor implemented control system, otherwise termed a control system firing head, "CS 1 FIRING HD" 17, connected to the pressure recorder 16 via a spacer; a perforating gun 18*c* connected to the CS 1 FIRING HD 17; a second microprocessor implemented control system "CS 2 FIRING HD" 17 connected to the perforating gun 18*c*; and a perforating gun 18*d* connected to the CS 2 FIRING HD 17.

In FIG. 2*b*, another embodiment of the perforating apparatus 18 is also suspended from pressure recorder 16, the pressure recorder being suspended from the slotted tail pipe 15. The perforating apparatus 18 in FIG. 2*b* also includes the CS 1 FIRING HD 17 connected to the recorder 16 via a spacer, and a perforating gun 1 18*c* connected to the CS 1 FIRING HD 17. However, a perforating gun 2 18*d* is suspended from the perforating gun 1 18*c*, both perforating guns 18*c* and 18*d* being fired by CS 1 FIRING HD 17. This group of perforating guns 18*c* and 18*d* are illustrated in FIG. 8. The CS 2 FIRING HD 17 is shown in FIG. 2*b* as being connected to the perforating gun 2 18*d* via a spacer. A perforating gun 3 18*e* is connected to the CS 2 FIRING HD 17.

Referring to FIG. 3, a construction of each microprocessor implemented control system (the CS 1 FIRING HD and the CS 2 FIRING HD) 17 of FIG. 2 is illustrated. The control system 17 shown in FIGS. 3, 4, 8*a* and 8*b* refers specifically to the CS 1 FIRING HD 17, PERF GUN 1 18*c*, and PERF GUN 2 18*d* of FIG. 2*b*; however, it should be understood that each control system 17 and associated perforating gun of FIGS. 2*a* and 2*b* is constructed in the same or similar manner as shown in FIGS. 3, 4, 8*a* and 8*b*. This control system 17 is described in additional detail in U.S. Pat. Nos. 4,796,699 and 4,856,595, which patents are also assigned to the assignee of the present invention. The control system 17 includes a command sensor 17*a*, a command receiver board 17*b* connected to the command sensor 17*a*, a controller board 17*c* connected to the receiver board 17*b*, and a driver board 17*d* connected to the controller board 17*c*. The driver board 17*d* generates two output signals on different occasions, output signal A and output signal B, as indicated in FIG. 3. The command sensor 17*a* is discussed below, and the controller board 17*c* is microprocessor implemented, which is also discussed below. A power supply board 17*e*, driven by a battery 17*f*, provides the needed power to the receiver board 17*b*, controller board 17*c*, and driver board 17*d*.

Referring to FIG. 4, the controller board 17*c* includes a microprocessor 17*c*1 connected to a system bus 17*c*3 and a read only memory (ROM) 17*c*2 connected to the system bus 17*c*3. In the preferred embodiment, the microprocessor 17*c*1 is an Intel 8088 microprocessor available for purchase from Intel, Corporation. The ROM 17*c*2 two signatures therein, a first stored signature and a second stored signature. The first and second stored signatures are compared with the signature of an input stimulus that is received by the command sensor 17*a*, a function which will also be discussed in more detail below.

Referring to FIG. 5, a diagram of a first type of input stimulus is illustrated, the input stimulus being received by command sensor 17*a* of the control system 17 of FIG. 3. Two different pressure pulses are generated by a user at the well surface, the pressure pulses being transmitted down the annulus space 13 of FIG. 1. In FIG. 5, the two pressure pulses are each illustrated as being less than 500 psi in amplitude and having first and second unique pulse-widths T-1 and T-2, respectively. These pressure pulses are intended to be annulus pressure pulses, that is, pressure transmitted down the annulus space 13 via port 14*a* as shown in FIG. 1; however, other types of input stimuli could also be transmitted or used by an operator at the well surface, such other types also being received by command sensor 17*a* of FIG. 3.

Referring to FIGS. 6 and 7, apparatus for generating such other types of input stimuli, which stimuli are received by the command sensor 17*a* of control system 17 of FIG. 3, is illustrated. The apparatus associated with these other types of input stimuli is disclosed in prior pending application Ser. No. 07/295,874, filed Jan. 11, 1989, entitled "Multiple Well Tool Control Systems in a Multi-Valve Well Testing System Having Automatic Control Modes", the disclosure of which has already been incorporated herein by reference.

In FIG. 6, a detailed construction of a portion of the tubing 11 enclosing the control system 17 of FIG. 2 is illustrated. Section A in FIG. 6 emphasizes a command sensor pressure transducer 17*a*; in this figure, the command sensor pressure transducer 17*a* senses tubing pressure (i.e., pressure within the tubing 11). A channel 11*a* in tubing 11 allows the tubing pressure, disposed within the internal part of tubing 11, to be exerted on command sensor pressure transducer 17*a*, the pressure transducer 17*a* generating an output signal 17*a*1 in response thereto, the output signal 17*a*1 energizing the command receiver board 17*b* in the block labelled 17*b*, 17*c*, 17*d*, & 17*e*. Output signals A and B, generated by driver board 17*d*, are conducted along a conductor 17*d*1 in FIG. 6 which is connected to the output of driver board 17*d*.

FIG. 7 illustrates another type of command sensor 17*a*. Replace section A in FIG. 6 with section A in FIG. 7. In FIG. 7, the command sensor is a command sensor strain gauge 17*a* which senses the stress and strain in tubing 11 when the tool of FIGS. 1 and 2 is disposed in a borehole, e.g., it senses the set down weight of the tool. For example, when the tool of FIGS. 1 and 2 is lowered into the borehole, the tool is set in place within the borehole at a desired depth. When the tool is set in place, the command sensor strain gauge 17*a* would sense the set down weight of the tool and generate an output signal, the output signal propagating along conductor 17*a*1 of FIG. 7 to the command receiver board 17*b*.

Figure 8B:
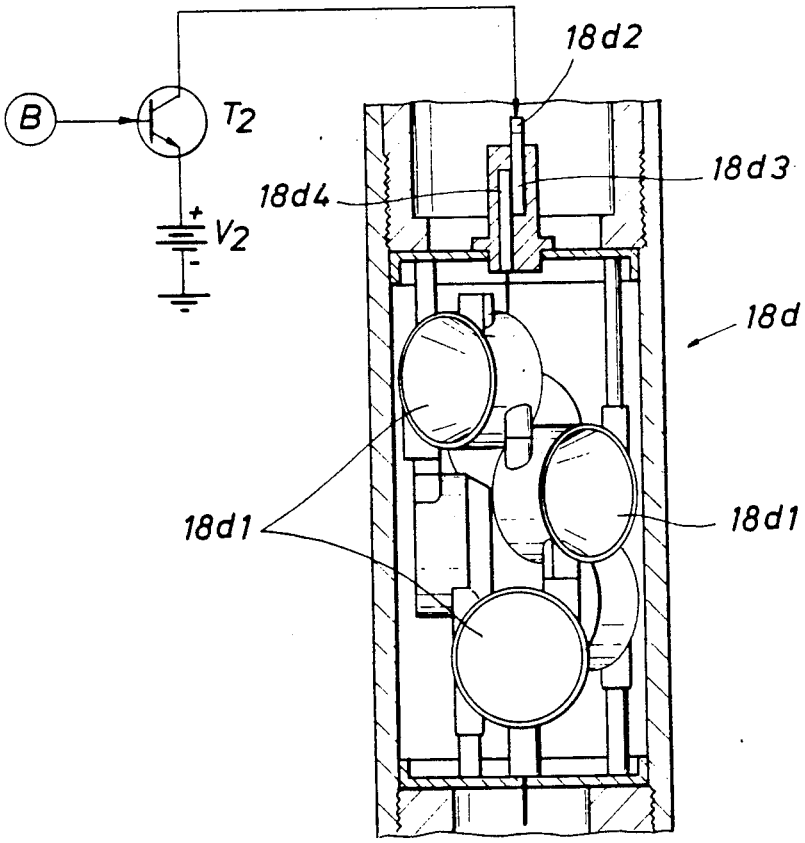

Referring to FIGS. 8*a*–8*b*, the perforating guns 18*c* and 18*d* of FIGS. 2*a*–2*b* are illustrated. Perforating gun 18*e* may be constructed in the same manner as illustrated in FIGS. 8*a*–8*b*. Perforating gun 18*c* is separate and distinct from perforating gun 18*d*, each perforating gun being capable of detonating independently from any other perforating gun. A perforating gun of the type shown in FIGS. 8*a*–8*b* is discussed in U.S. Pat. No. 4,744,424 to Lendermon et al, the disclosure of which is incorporated by reference into this specification.

In FIGS. 8*a* and 8*b*, perforating gun 18*c* includes a plurality of shape charges 18*c*1 that are phased, i.e. pointing in different directions; in addition, perforating gun 18*d* also includes a plurality of shape charges 18*d*1 that are phased. Perforating gun 18*c* includes a detonating cord 18*c*2 that is connected to the collector of a transistor T1, the emitter of transistor T1 being connected to a battery V1, the base of transistor T1 being responsive to output signal A from the control system (CS FIRING HD) 17 of FIG. 3. The detonating cord 18*c*2 is also connected to detonators 18*c*3 and 18*c*4 disposed in side-by-side relation to one another. Detonator 18*c*3 is appropriately selected so as to be electrically actuated. Similarly, perforating gun 18*d* includes a detonating cord 18*d*2 that is connected to the collector of a transistor T2, the emitter of transistor T2 being connected to a battery V2, the base of transistor T2 being responsive to output signal B from the control system (CS FIRING HD) 17 of FIG. 3. The detonating cord 18*d*2 is also connected to detonators 18*d*3 and 18*d*4 disposed in side-by-side relation to one another. Detonator 18*d*3 is appropriately selected so as to be actuated by electrical means. Detonators 18*c*4 and 18*d*4 are each connected to a detonating cord which is further connected to each of the shape charges 18*c*1 and 18*d*1, respectively. Actuation of detonating cord 18*c*2 by electrical actuation will detonate the detonator 18*c*3 and the detonator 18*c*4, detonation of detonator 18*c*4 igniting the detonating cord connected to each shape charge 18*c*1 thereby detonating the shape charges 18*c*1. Actuation of detonating cord 18*d*2 by electrical actuation will detonate the detonator 18*d*3 and the detonator 18*d*4, detonation of detonator 18*d*4 igniting the detonating cord connected to each shape charge 18*d*1 thereby detonating the shape charges 18*d*1. Detonating cord 18*c*2 of perforating gun carrier 18*c* is responsive to current from battery V1; whereas detonating cord 18*d*2 of perforating gun carrier 18*d* is responsive to current from battery V2, the batteries V1 and V2 delivering their currents when transistors T1 and T2 conduct, the transistors T1 and T2 conducting in response to output signals A and B from the driver board 17*d* of control system 17 shown in FIG. 3.

A functional description of the perforating apparatus of FIGS. 1–8*b*, a first embodiment of the present invention, will be set forth in the following paragraphs. This functional description will relate the function of the perforating apparatus when the input stimulus to the command sensor 17*a* of control system (CS FIRING HD) 17 is either the annulus pressure pulses of FIG. 5, the tubing pressure of FIG. 6, or the strain gauge output of FIG. 7.

If the control system (CS FIRING HD) 17 of FIG. 3 is designed to receive annulus pressure pulses, as in FIG. 5, when an operator transmits the pressure pulses of FIG. 5 downhole into annulus space 13, the command sensor 17*a* of FIG. 3 senses the presence of such annulus pressure pulses and generates a corresponding output signal, the command receiver board 17*b* receiving the corresponding output signal.

However, if the control system (CS FIRING HD) 17 of FIG. 3 is designed to receive tubing pressure pulses transmitted into the interior of tubing 11, when the tubing pressure is sensed by the tubing pressure command sensor 17*a* of FIG. 6, a corresponding output signal is generated by the tubing pressure command sensor 17*a* of FIG. 6, the command receiver board 17*b* receiving the corresponding output signal.

Furthermore, if the control system (CS FIRING HD) 17 of FIG. 3 is designed to sense a set down weight of the tool of FIG. 1 when the tool is finally set in place at the desired depth in the borehole, the strain gauge command sensor 17*a* of FIG. 7 senses the stress and strain existing in tubing 11 following the setting of the tool at its desired depth in the borehole. When the stress and strain is sensed by the strain gauge command sensor 17*a* of FIG. 7, the strain gauge command sensor 17*a* generates a corresponding output signal, the command receiver board 17*b* receiving the corresponding output signal.

The annulus pressure, the tubing pressure, and the stress and strain in tubing 11 each represent an "input stimulus". Furthermore, the input stimulus possesses its own unique "signature", that is, its own unique identifying characteristics. Therefore, when the input stimulus is received by the command sensor 17*a*, the corresponding output signal generated by the command sensor 17*a* also possesses this same corresponding unique "signature".

When the command receiver board 17*b* receives the corresponding output signal from the command sensor 17*a*, the receiver board 17*b* generates its own output signal in a format acceptable by the microprocessor 17*c*1 of the controller board 17*c*; however, this output signal also possesses the same signature as that of the corresponding output signal from the command sensor 17*a* and of the received input stimulus. The microprocessor 17*c*1 compares the received signature of the output signal from the command receiver board 17*b* with the first stored signature stored in ROM 17*c*2 and with the second stored signature also stored in ROM 17*c*2, the microprocessor 17*c*1 of the controller board 17*c* generating a first output signal when the received signature matches the first stored signature and generating a second output signal when the received signature matches the second stored signature. The driver board 17*d* responds by generating output signal A in response to the first output signal from the controller board 17*c* and by generating output signal B in response to the second output signal from the controller board 17*c*. In FIGS. 8*a* and 8*b*, when the output signal A from the driver board 17*d* is received by transistor T1, the transistor T1 conducts. When this occurs, battery V1 transmits its current to detonating cord 18*c*2, and to detonator 18*c*3. Since the detonator 18*c*3 may be electrically actuated, the detonator 18*c*3 detonates in response to current from battery V1, which, in turn, detonates the detonator 18*c*4, which, in turn, ignites the detonating cord connected to each shape charge 18*c*1. The shape charges 18*c*1 detonate, and perforate the formation in the borehole. However, when the output signal B from the driver board 17*d* is received by transistor T2, transistor T2 conducts. When this occurs, battery V2 delivers its current to detonating cord 18*d*2 and to detonator 18*d*3. Since the detonator 18*d*3 activates in response to an electrical signal, the detonator 18*c*3 detonates in response to output signal B which, in turn, detonates the detonator 18*d*4, which, in turn, ignites the detonating cord connected to each shape charge 18*d*1. The shape charges 18*d*1 detonate, and perforate the formation in the borehole.

The important benefit to be derived from the above referenced functional description is that an operator at the well surface may, at his option, either perforate a lowermost part of the borehole formation or an uppermost part of the borehole formation, depending upon the particular signature of the input stimulus chosen by the operator. The operator may choose to perforate the uppermost part of the formation before the lowermost part of the formation, or he may choose to perforate the lowermost part of the formation before the uppermost part.

Figure 9:
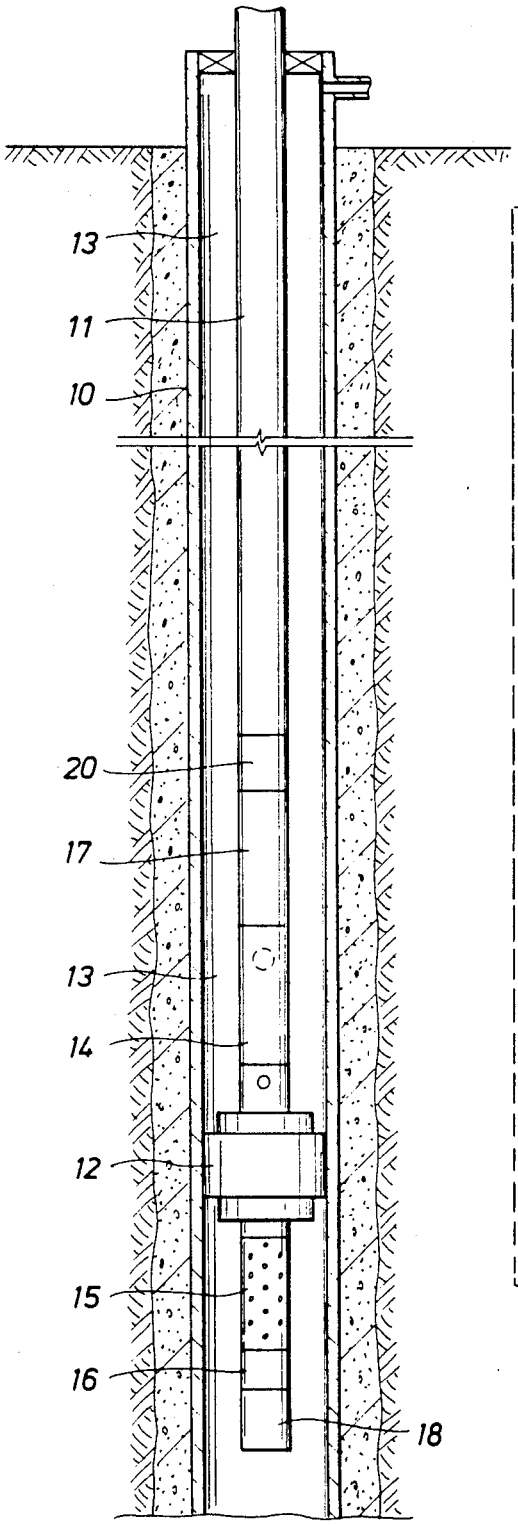
FIG. 9 illustrates a well testing system including an inductive coupler, a microprocessor implemented control system similar to the control system of FIGS. 3 and 4 that is responsive to the inductive coupler, and a solenoid actuated valve apparatus responsive to the control system.

Referring to FIG. 9, another string of drill stem testing tools is shown suspended in a well bore 10 on drill pipe or tubing 11. The testing tools comprise a typical packer 12 that acts to isolate the well interval being tested (below the packer 12) from the hydrostatic head of fluids standing in the annulus space 13 thereabove; and a solenoid actuated test valve assembly 14 that serves to permit or to prevent the formation fluids from the isolated interval (below the packer) from entering the pipe string 11. The solenoid actuated test valve assembly 14 is closed while the tools are being lowered, so that the interior of the tubing provides a low pressure region into which formation fluids can flow. After the packer 12 is set, the valve 14 is opened for a relatively short flow period of time during which pressures in the well bore are reduced. Then, the valve 14 is closed for a longer flow period of time during which pressure build-up in the shut-in well bore is recorded. A perforated tail pipe 15 is connected to the lower end of the mandrel of the packer 12 to enable fluids in the well bore to enter the tool string, and typical pressure recorders 16 are provided for the acquisition of pressure data as the test proceeds. A perforating apparatus 18 is connected to the pressure recorders 16.

In accordance with another embodiment of the present invention, a microprocessor implemented control system 17 is embodied in the walls of tubing 11 above the solenoid actuated test valve assembly 14 and an inductive coupler 20 is embodied in the wall of tubing 11 above the control system 17. The inductive coupler 20 is responsive to signals from the well surface for transmitting a corresponding output signal, the output signal acting as an input stimulus to the control system 17. The control system 17 provides the needed output signals to the solenoid actuated test valve assembly 14, the assembly 14 opening or closing the test valve 14 in response to the output signals from the control system 17.

Figure 10:
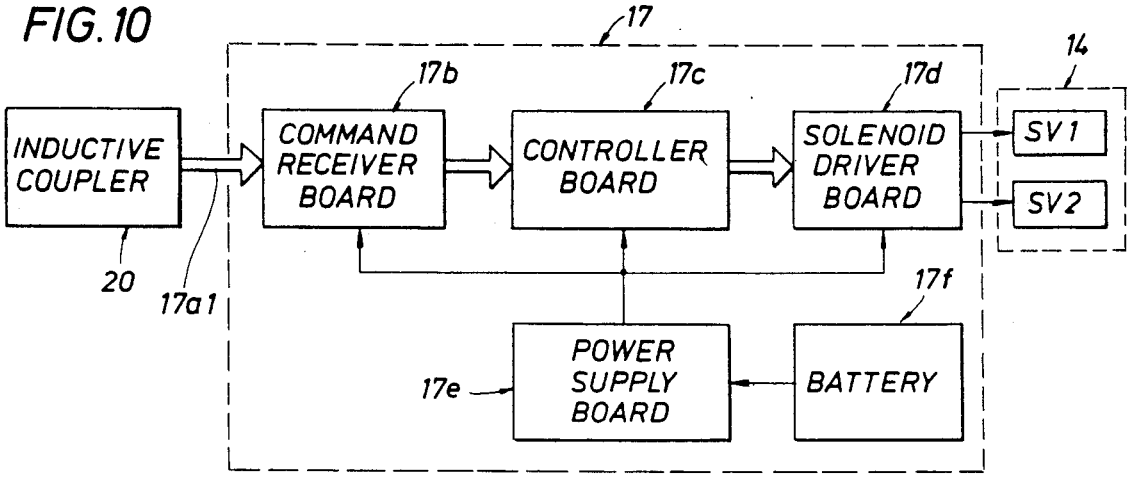
FIGS. 10 and 11 illustrate in greater detail the construction of the control system and the solenoid actuated valve apparatus.
Figure 11:
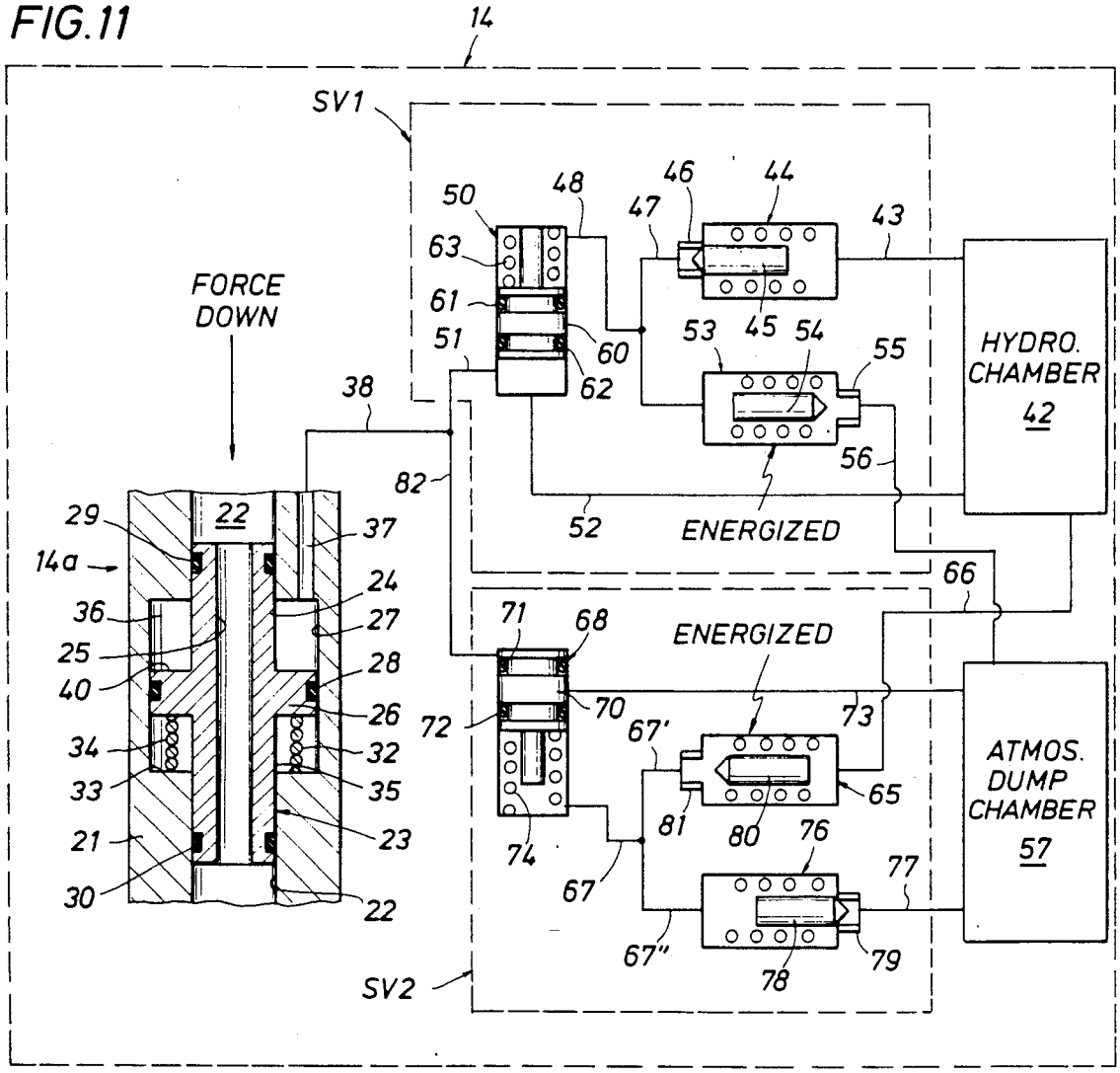

Referring to FIG. 10, a microprocessor implemented control system 17 is illustrated, the control system 17 of FIG. 10 being identical to the CS FIRING HD 17 shown in FIG. 3, except that the command sensor 17*a* in FIG. 3 has been removed. In lieu of the command sensor 17*a*, an inductive coupler 20 provides an output signal 17*a*1 in FIG. 10 which energizes the command receiver board 17*b* of the control system 17. The control system 17 comprises the command receiver board 17*b* connected to a controller board 17*c*. The controller board 17*c* is described in detail in this specification with reference to FIG. 4 of the drawings. As noted with reference to FIG. 4, the controller board 17*c* includes a microprocessor 17*c*1 (Intel 8088) connected to a system bus 17*c*3, and a read only memory 17*c*2 also connected to the system bus for storing the 1st stored signature and the 2nd stored signature. The controller board 17*c* is connected to a solenoid driver board 17*d*, which driver board 17*d* drives a set of solenoid actuated pilot valves SV1 and SV2. The solenoid actuated pilot valves SV1 and SV2 are shown in FIG. 11 of the drawings. A power supply 17*e* and battery 17*f* power the controller board 17*c*, command receiver board 17*b*, and solenoid driver board 17*d*. The control system 17 of FIG. 10 is also described in U.S. Pat. No. 4,856,595 to Upchurch, the disclosure of which has already been incorporated by reference into this specification.

Referring to FIG. 11, the solenoid actuated test valve assembly 14 is illustrated, the test valve assembly 14 including the solenoid actuated pilot valves SV1 and SV2. The solenoid actuated test valve assembly 14 of FIG. 11 is discussed in detail in U.S. Pat. Nos. 4,796,699 and 4,856,595 to Upchurch, the disclosures of which have already been incorporated by reference into this specification. The same numerals used in the '699 patent and the '595 patent to Upchurch have been used in FIG. 11 of this specification.

In FIG. 11, a circulating valve (or test valve) 14*a* is connected in the solenoid actuated test valve assembly 14 as noted in FIG. 9. The test valve 14*a* includes an elongated tubular housing 21 having a central flow passage 22. A valve actuator 23 is slidably mounted in the housing 21, and includes a mandrel 24 having a central passage 25 and an outwardly directed annular piston 26 connected to mandrel 24 and sealed by a seal ring 28 with respect to a cylinder 27 in the housing. Additional seal rings 29, 30 are used to prevent leakage between the cylinder 27 and the passage 22. The seal rings 29, 30 preferably engage on the same diameter so that the mandrel 24 is balanced with respect to fluid pressures within the passageway 22. A coil spring 32 located in the housing below the piston 26 reacts between an upwardly facing surface 33 at the lower end of the cylinder 27 and a downwardly facing surface 34 of the piston 26. The spring 32 provides upward force tending to shift the mandrel 24 upwardly relative to the housing 21. The annular area 35 in which the spring 32 is positioned contains air at atmospheric or other low pressure. The cylinder area 36 above the piston 26 is communicated by a port 37 to a hydraulic line 38 through which oil or other hydraulic fluid is supplied under pressure. A sufficient pressure acting on the upper face 40 of the piston 26 will cause the mandrel 24 to shift downward against the resistance afforded by the coil spring 32, and a release of such pressure will enable the spring to shift the mandrel upward to its initial position. The reciprocating movement of the mandrel 24 is employed, as will be described subsequently, to actuate any one of a number of different types of valve elements which control the flow of fluids either through the central passage 22 of the housing 21, or through one or more side ports through the walls of the housing 21.

The source of hydraulic fluid under pressure is a chamber 42 that is filled with hydraulic oil. As will be explained below, the chamber 42 is pressurized by the hydrostatic pressure of well fluids in the well annulus 13 acting on a floating piston which transmits such pressure to the oil. A line 43 from chamber 42 leads to a first solenoid valve 44 which has a spring loaded, normally closed valve element 45 that engages a seat 46. Another line 47 leads from the seat 46 to a line 48 which communicates with a first pilot valve 50 that functions to control communication between a hydraulic line 51 that connects with the actuator line 38 and a line 52 that also leads from the high pressure chamber 42. A second solenoid valve 53 which also includes a spring loaded, normally closed valve element 54 engageable with a seat 55 is located in a line 56 that communicates between the lines 47, 48, and a dump chamber 57 that initially is empty of liquids, and thus contains air at atmosphere on other low pressure.

The pilot valve 50 includes a shuttle element 60 that carried seal rings 61, 62, and which is urged toward a position closing off the cylinder line 51 by a coil spring 63. However, when the second solenoid valve 53 is energized open by an electric current, the shuttle 60 will shift to its open position as shown, hydraulic fluid behind the shuttle 60 being allowed to exhaust via the lines 48 and 56 to the low pressure dump chamber 57. With the pilot valve 50 open, pressurized oil from the chamber 42 passes through the lines 52, 51, and 38 and into the cylinder region 36 above the actuator piston 26. The pressure of the oil, which is approximately equal to hydrostatic pressure, forces the actuator mandrel 24 downward against the bias of the coil spring 32.

The hydraulic system as shown in FIG. 11 also includes a third, normally closed solenoid valve 65 located in a line 66 that extends from the chamber 42 to a line 67 which communicates with the pressure side of a second pilot valve 68. The pilot valve 68 also includes a shuttle 70 that carries seal rings 71, 72, and which is urged toward its closed position by a coil spring 74, where the shuttle closes an exhaust line 73 that leads to the dump chamber 57. A fourth, normally closed solenoid valve 76 is located in a line 77 which communicates between the pressure line 67 of the pilot valve 68 and the dump chamber 57. The solenoid valve 76 includes a spring biased valve element 78 that coacts with a seat 79 to prevent flow toward the dump chamber 57 via the line 77 in the closed position. In like manner, the third solenoid valve 65 includes a spring-loaded, normally closed valve element 80 that coacts with a seat 81 to prevent flow of oil from the high pressure chamber 42 via the line 66 to the pilot input line 67 except when opened, as shown, by electric current supplied to its coil. When the solenoid valve 65 is open, oil under pressure supplied to the input side of the pilot valve 68 causes the shuttle 70 to close off the dump line 73. Although high pressure also may be present in the line 82 which communicates the outer end of the shuttle 70 with the lines 51 and 38, the pressures in lines 67 and 82 are equal, whereby the spring 74 maintains the shuttle closed across the line 73. Although functionally separate pilot valve has been show, it will be recognized that a single three-way pilot valve could be used.

In order to permit the power spring 32 to shift the actuator mandrel 24 upward from the position shown in FIG. 2, the first and fourth solenoid valves 44 and 76 are energized, and the second and third solenoid valves 53 and 65 simultaneously are de-energized. When this occurs, the solenoid valves 53 and 65 shift to their normally closed positions, and the valves 44 and 76 open. The opening of the valve element 45 permits pressures on opposite sides of the shuttle 60 to equalize, whereupon the shuttle 60 is shifted by its spring 63 to the position closing the cylinder line 51. The valve element 54 of the solenoid valve 53 closes against the seat 55 to prevent pressure in the chamber 42 from venting to the dump chamber 57 via the line 56. The closing of the valve element 80 and the opening of the valve element 78 communicates the pilot line 67 with the dump chamber 57 via line 77, so that high cylinder pressure in the lines 38 and 82 acts to force the shuttle 70 to shift against the bias of the spring 74 and to open up communication between the lines 82 and 73. Thus hydraulic fluid in the cylinder region 36 above the piston 26 is bled to the dump chamber 57 as the power spring 32 extends and forces the actuator mandrel 24 upward to complete a cycle of downward and upward movement. The solenoid valves 44, 53, 65, and 76 can be selectively energized in pairs, as described above, to achieve additional cycles of actuator movement until all the hydraulic oil has been transferred from the chamber 42 to the dump chamber 57. Of course the actuator mandrel 20 is maintained in either its upward or its downward position when all solenoid valves are de-energized.

Figure 12:
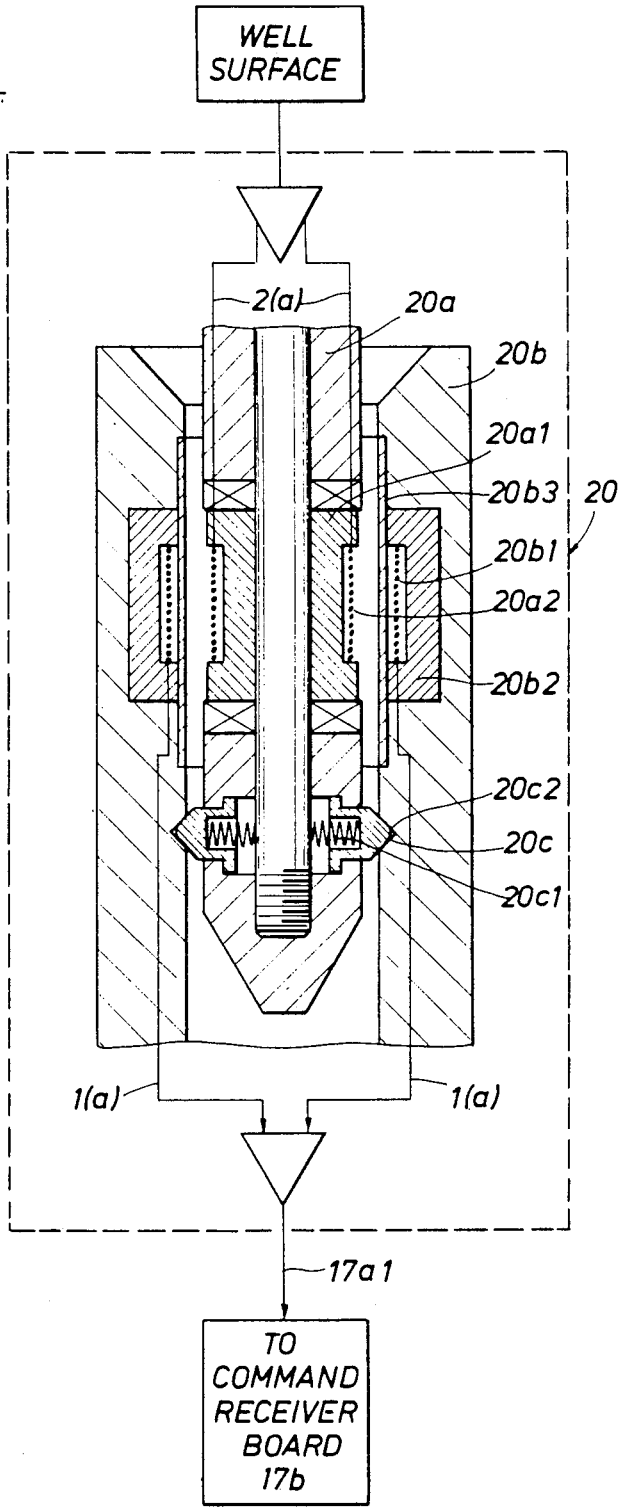
FIG. 12 illustrates in greater detail the inductive coupler of FIG. 9.

Referring to FIG. 12, the inductive coupler 20 of FIG. 10 is illustrated, the inductive coupler 20 providing an input stimulus 17*a*1 to the command receiver board 17*b* of the control system 17 of FIG. 10. The inductive coupler 20 is fully described and set forth in U.S. Pat. No. 4,806,928 to Veneruso and in application Ser. No. 310,804 filed Feb. 14, 1989 entitled "Apparatus for Electromagnetically Coupling Power and Data Signals Between a First Unit and a Second Unit and in particular between Well Bore Apparatus and the Surface", the disclosures of which have already been incorporated by reference into this specification.

In FIG. 12, the inductive coupler 20 includes a male member 20*a* and a female member 20*b*. The male member 20*a* includes an inner core 20*a*1 and an inner coil 20*a*2 disposed around the inner core 20*a*1. The two ends 2(*a*) of the inner coil 20*a*2 are connected to a unit disposed at the well surface. The female member 20*b* includes an outer coil 20*b*1 enclosed by an outer core 20*b*2, the outer coil 20*b*1 being protected by a polymer protective sleeve 20*b*3. The two ends 1(*a*) of the outer coil 20*b*1 are connected to the command receiver board 17*b* of control system 17. Note that the control system 17 of FIG. 10 does not include a command sensor 17*a*; the command sensor 17*a* is not needed, since the inductive coupler 20 is providing the output signal 17*a*1 normally provided by the command sensor 17*a* of FIG. 3. The male member 20*a* is movable with respect to the female member 20*b*, and, in order that the male member 20*a* may be concentrically disposed with respect to the female member 20*b*, the male member 20*a* is latched to female 20*b* by latch 20*c*. The latch 20*c* is spring biased by a spring 20*c*1 which biases the latch 20*c* into engagement with interior groove 20*c*2.

A very important structural requirement with respect to the inductive coupler 20 is the structure of the inner and outer cores 20*a*1 and 20*b*2, respectively. In order to achieve maximum efficiency with respect to the inductive coupling of power and/or data signals between the well surface and the control system 17, the cores 20*a*1 and 20*b*b must each be comprised of any suitable material which has a magnetic permeability greater than that of air and, simultaneously, an electrical resistivity greater than that of solid iron. Magnetic permeability if a property of a material which modifies the action of the magnetic poles of the material and which modifies its own magnetic induction when the material is placed in a magnetic force. One such suitable material, used in association with the preferred embodiment, is a ferrite material that includes ceramic magnetic materials formed of ionic crystals and having the general chemical composition $MeFe_2O_3$, where Me is selected from a group consisting of Manganese, Nickel, Zinc, Magnesium, Cadmium, Cobalt and Copper. However, other materials may also constitute a suitable material for the purposes of the inner and outer cores 20*a*1 and 20*b*2 of FIG. 8, such as iron based magnetic alloy materials which have the required magnetic permeability greater than that of air and which have been formed to create a core that also exhibits an electrical resistivity greater than that of solid iron. Examples of such iron based magnetic alloy materials include high purity iron; 50% iron and 50% cobalt; 96% iron and 4% silicon; or appropriate combinations of iron and either nickel, cobalt, molybdenum, or silicon. Since resistivity is the reciprocal of conductivity, a high electrical resistivity, greater than that of solid iron, connotes a correspondingly low electrical conductivity. Using the iron based magnetic alloy materials, the low electrical conductivity (high electrical resistivity) parameter of the material which constitutes the core is achieved by appropriate processing and forming of the iron based magnetic alloy materials in the following manner: by winding thin foils of the iron alloy into tape form, or by laminating thin foils of an iron alloy together, and by interleaving an insulator material in between adjacent layers of the iron alloy foils, the electrical resistivity of the resultant tape or laminated foil product is greater than that of iron; or by binding powdered iron alloy particles together into a non-electrically conductive matrix, using an epoxy polymer, ceramic or a suitable adhesive, the resistivity of the resultant iron alloy/non-conductive matrix is greater than that of iron. A typical insulator material used in association with the above referenced winding and laminating step is a high temperature polymer.

A functional description of the well testing apparatus of FIGS. 9 through 12, a second embodiment of the present invention, will be set forth in the following paragraphs.

An operator at the well surface chooses an electrical input signal having a predetermined signature, the signature uniquely identifying the input signal as being associated with one of two operating states (open or closed) of the circulating (test) valve 14*a* of FIG. 11. The operator transmits the electrical input signal from the well surface down the male member 20*a* of the inductive coupler via conductors 2(*a*). The input signal current flows through the inner coil 20*a*2. As a result of the materials which comprise the inner and outer core 20*a*1 and 20*b*2, a corresponding signal is induced in the outer coil 20*b*1, the corresponding signal being an excellent representation of the input signal flowing in the inner coil 20*a*2. The corresponding signal flows through conductors 1(*a*) and is eventually received by the command receiver board 17*b* of the control system 17 in FIG. 10. The corresponding signal possesses the same signature that was possessed by the electrical input signal transmitted down conductor 2(*a*) by the operator at the well surface. The signature of the corresponding signal is compared, in microprocessor 17*c*1 of controller board 17*c* with the two stored signatures which are stored in the ROM 17*c*2 of controller board 17*c*. If a match is found between the signature of the corresponding signal and the 1st stored signature, solenoid driver board 17*d* generates an output signal which energizes the solenoid actuated pilot valves SV1 and SV2 of FIG. 11 in a way which admits the oil in the hydrochamber 42 into port 37 and into cylinder area 36 of FIG. 11 and to thereby move the mandrel 24 downwardly in FIG. 11 and opening the test valve 14*a*; whereas if a match is found between the signature of the corresponding signal and the 2nd stored signature, solenoid driver board 17*d* generates an output signal which energizes the solenoid actuated pilot valves SV1 and SV2 of FIG. 11 in a way which allows the oil in cylinder area 36 to dump to the dump chamber 57 and to thereby move the mandrel 24 upwardly in the FIG. 11 and closing the test valve 14*a*.

An important characteristic of this embodiment of the present invention is the use of an inductive coupler 20 to provide the necessary input stimulus to the control system 17. If the input stimuli of FIGS. 5, 6, and 7 are not desired, an inductive coupler 20 of FIG. 12 may provide the necessary input stimulus.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A system for generating control signals and for changing a state of a device in response to said control signals, comprising:

inductive coupler means including a first coil connected to a first point and a second coil connected to a second point, said first coil and said second coil adapted to inductively couple said first point to said second point, an input signal from said first point propagating through said first coil, a corresponding signal being induced in said second coil, the corresponding signal propagating from said second coil to said second point;

control means connected to said second point and responsive to said corresponding signal for generating said control signals, the control means including, memory means for storing a first stored signature and a second stored signature, and processor means connected to said second point and to said memory means and responsive to said corresponding signal from said second point for generating a first of said control signals when said first stored signature in said memory means at least most nearly matches a signature of said corresponding signal and for generating a second of said control signals when said second stored signature in said memory means at least most nearly matches a signature of said corresponding signal;

the state said device changing from a first state to a second state in response to said first of said control signals, the state of said device changing from said second state to said first state in response to said second of said control signals.

2. The system of claim 1, wherein said first coil is a male coil and said second coil is a female coil, the male coil adapted to be disposed within the female coil for inductively coupling said first point to said second point.

3. The system of claim 2, wherein said system is a well testing system adapted to be disposed in a borehole and said device is a valve adapted to change between an open state and a closed state.

4. A method of changing a state of a device, comprising the steps of:

energizing a first coil of an inductive coupler, a signal flowing in said first coil;

inducing a corresponding signal in a second coil of the inductive coupler;

receiving said corresponding signal in a processor of a control system connected to the second coil;

retrieving a first signature from a memory of said control system and receiving said first signature in said processor, the processor comparing said first signature with a signature of said corresponding signal;

generating a first control signal from the processor when the first signature at least most nearly matches the signature of said corresponding signal;

retrieving a second signature from the memory of said control system and receiving said second signature in said processor, the processor comparing said second signature with the signature of said corresponding signal;

generating a second control signal from the processor when the second signature at least most nearly matches the signature of said corresponding signal;

changing the state of the device from a first state to a second state in response to said first control signal; and changing the state of the device from the second state to the first state in response to said second control signal.

5. The method of claim 4, wherein said first coil is a male coil and said second coil is a female coil, and wherein, prior to the energizing step, the method comprises the step of:

inserting said male coil within said female coil.

6. The method of claim 5, wherein:

said method if practiced by a well testing system when said well testing system is disposed in a borehole; and said device is a valve, the first state of said valve being a closed state, the second state of said valve being an open state.

* * * * *